US006677388B2

(12) United States Patent
Chakrabarty et al.

(10) Patent No.: US 6,677,388 B2
(45) **Date of Patent: *Jan. 13, 2004**

(54) WAX TRANSPORT COMPOSITION

(75) Inventors: Tapan Chakrabarty, Calgary (CA); Robert Jay Wittenbrink, Kingwood, TX (US); Paul Joseph Berlowitz, Glen Gardner, NJ (US); Loren Leon Ansell, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/909,376

(22) Filed: Jul. 20, 2001

(65) Prior Publication Data

US 2002/0077370 A1 Jun. 20, 2002

Related U.S. Application Data

(63) Continuation-in-part of application No. 08/928,237, filed on Sep. 12, 1977, now Pat. No. 6,284,806.

(51) Int. Cl.[7] ..... B01F 3/12; B01F 17/42; C10L 1/32

(52) U.S. Cl. ..... 516/77; 516/924; 516/928; 44/280; 44/302; 137/13

(58) Field of Search ..... 516/51, 76, 77, 516/924, 928; 44/280, 301, 302; 137/13

(56) References Cited

U.S. PATENT DOCUMENTS

| | | | | | |
|---|---|---|---|---|---|
| 3,551,169 | A | * | 12/1970 | Cangdon | 516/40 |
| 3,553,130 | A | * | 1/1971 | Stratton | 516/76 |
| 3,630,953 | A | * | 12/1971 | Simon et al. | 516/51 |
| 3,776,248 | A | * | 12/1973 | Titus | 137/13 |
| 3,876,391 | A | | 4/1975 | McCoy et al. | 44/301 |
| 3,985,932 | A | * | 10/1976 | Porter | 106/213.1 |
| 4,183,757 | A | | 1/1980 | Groszek et al. | 106/14.11 |
| 4,374,879 | A | * | 2/1983 | Roberts et al. | 215/DIG. 6 |
| 4,435,309 | A | * | 3/1984 | House | 516/77 |
| 4,675,022 | A | * | 6/1987 | Danner | 252/8.61 |
| 4,732,576 | A | | 3/1988 | Friedrich et al. | 44/301 |
| 4,743,660 | A | | 5/1988 | Danner et al. | 525/382 |
| 4,793,850 | A | * | 12/1988 | Koester et al. | 106/271 |
| 4,832,774 | A | * | 5/1989 | DiFrank et al. | 156/215 |
| 5,236,624 | A | * | 8/1993 | Lepert et al. | 516/928 |
| 5,283,001 | A | * | 2/1994 | Gregoli et al. | 137/13 |
| 5,348,982 | A | * | 9/1994 | Herbolzheimer et al. | 518/700 |
| 5,387,434 | A | * | 2/1995 | Black | 134/34 |
| 5,405,439 | A | * | 4/1995 | Marchal | 516/43 |
| 5,545,674 | A | * | 8/1996 | Behrmann et al. | 518/715 |
| 6,068,670 | A | | 5/2000 | Haupais et al. | 44/301 |
| 6,284,806 | B1 | * | 9/2001 | Chakrabarty et al. | 516/77 |
| 6,294,587 | B1 | * | 9/2001 | Wittenbrink et al. | 516/76 |
| 6,325,833 | B1 | * | 12/2001 | Berlowitz et al. | 516/71 |
| 6,458,855 | B1 | * | 10/2002 | Wittenbrink et al. | 516/76 |

FOREIGN PATENT DOCUMENTS

| | | | | |
|---|---|---|---|---|
| CA | 2159942 | * | 4/1996 | |
| EP | 0363300 | | 11/1990 | C10L/1/32 |
| WO | WO 97/08276 | * | 3/1997 | |
| WO | WO 99/13029 | | 3/1999 | |

OTHER PUBLICATIONS

McCutcheon's vol. 1: Emulsifiers & Detergents, 1993 North American Edition (McCutcheon Division, MC Publishing Co. Glen Rock, NJ, Copyright date 1993), p. 86, Jan. 1994.*

Hackh's Chemical Dictionary, Edited by Julius Grant (Mcgraw Hill Book Co., NY, NY copyright 1972) pp. 721–722, Dec. 1979.*

H. Bennet, Practical Emulsions A Handbook of Emulsions, Emulsifiers and Methods of Formulating and making emulsionsof practical valuein Industry (Chemical Publishing, NY, NY copyright 1943) pp. 438–447, Aug. 1943.*

Michael and Irene Ash, Handbood of Industrial Surfactants, Extract Igepal®CO–530, p. 257, copyright 1993, month unknown.

Michael and Irene Ash, Handbook of Industrial Surfactants, Extract Igepal®CO–610, p. 258, copyright 1993, month unknown.

Michael and Irene Ash, Handbook of Industrial Surfactants, Extract Sovatex MP/1, p. 494, copyright 1993, month unknown.

Michael and Irene Ash, Handbook of Industrial Surfactants, Extract Trymee®6623, p. 572, copyright 1993, month unknown.

Michael and Irene Ash, Handbook of Industrial Surfactants, Extract Tylose MH–K, MH–xp, MHB–y, MHB–yp, p. 583, copyright 1993, month unknown.

* cited by examiner

*Primary Examiner*—Daniel S. Metzmaier
(74) *Attorney, Agent, or Firm*—Charles J. Brumlik

(57) ABSTRACT

Wax in water emulsions prepared from Fischer-Tropsch derived waxes, Fischer-Tropsch process water, and two alkyl ethoxylated phenol nonionic surfactants having different hydrophilic-lipophilic balances provide high performance pipeline transport of waxes with reduced pipeline fouling.

11 Claims, No Drawings

WAX TRANSPORT COMPOSITION

This application is a Continuation-in-Part of U.S. Ser. No. 08/928,237 filed Sep. 12, 1977, and issued on Sep. 4, 2001 as U.S. Pat. No. 6,284,806.

FIELD OF THE INVENTION

This invention relates to a wax composition capable of being transported through pipelines.

BACKGROUND OF THE INVENTION

Hydrocarbon-water emulsions are well known and have a variety of uses, e.g., as hydrocarbon transport mechanisms, such as pipelines. These emulsions are generally described as macro emulsions, that is, where the emulsion is cloudy or opaque as compared to micro emulsions that are clear, translucent, and thermodynamically stable because of the higher level of surfactant used in preparing micro-emulsions.

The methods of making, e.g., wax emulsions, from petroleum derived materials are well known, but the material surfactants and co-solvents are usually expensive. Moreover, waxes produced from the Fischer-Tropsch process may be harder waxes, have higher melting points, are essentially odor free and free of sulfur and nitrogen, with low residual oils. These high melting point solids are, therefore, difficult to transport through pipelines.

Consequently, there is a need for a method of preparing low cost, stable emulsions of Fischer-Tropsch wax so the wax can be readily transported, e.g., through pipelines.

SUMMARY OF THE INVENTION

In accordance with this invention a stable, macro emulsion having a water continuous phase, wherein the emulsion comprises Fischer-Tropsch derived hydrocarbon waxes, Fischer-Tropsch process water, a first non-ionic surfactant, and a second non-ionic surfactant. Preferably, the emulsion is prepared in the substantial absence, e.g., <2 wt %, and preferably less than 1 wt %, absence of an addition of a co-solvent (e.g., alcohols).

The macro-emulsions that are the subject of this invention are generally easier to prepare and are more stable than the corresponding emulsion with petroleum derived hydrocarbons. For example, at a given surfactant concentration, the degree of separation of the emulsions is significantly lower than the degree of separation of emulsions containing petroleum derived hydrocarbons. Furthermore, the emulsions require the use of less surfactant than required for emulsions of petroleum derived hydrocarbon liquids, and do not require the use of co-solvents, such as alcohols, even though small amounts of alcohols may be present in the emulsions.

Preferred Embodiments

The Fischer-Tropsch derived waxes used in this invention are those hydrocarbons containing materials that are solid at room temperature. Thus, these materials may be the raw wax from the Fischer-Tropsch hydrocarbon synthesis reactor, such as $C_4$+ wax, preferably $C_5$+ wax. These materials generally contain at least about 90% paraffins, normal or iso-paraffins, preferably at least about 95% paraffins, and more preferably at least about 98% paraffins.

Generally, the emulsions contain up to about 90 wt % Fischer-Tropsch derived wax, preferably 20 to 90 wt % wax, more preferably 60 to 90 wt % Fischer-Tropsch derived wax. The water obtained from the Fischer-Tropsch process is particularly preferred and results in improved emulsions when compared to distilled water.

Fischer-Tropsch derived materials usually contain few unsaturates, e.g., <1 wt % olefins & aromatics, preferably less than about 0.5 wt % total aromatics, and nil-sulfur and nitrogen, i.e., less than about 50 ppm by weight sulfur or nitrogen.

The non-ionic surfactant is usually employed in relatively low concentrations. Thus, the total surfactant concentration, that is, just surfactant plus second surfactant is that sufficient to allow the formation of the macro, relatively stable emulsion. Preferably, the total amount of surfactant employed is at least about 0.005 wt % of the total emulsion, based on the weight of wax and Fischer-Tropsch process water, more preferably about 1–10 wt % and most preferably 1 to about 7 wt %. The first surfactant is typically a non-ionic surfactant having an HLB (hydrophilic-lipophilic balance) of at least 11, preferably about 11–15 and the second surfactant is a non-ionic surfactant having an HLB of less than 11, preferably 8 to less than 11.

Typically, non-ionic surfactants useful in preparing the emulsions of this invention are those used in preparing emulsions of petroleum derived or bitumen derived materials, and are well known to those skilled in the art. Useful surfactants for this invention include alkyl ethoxylates, linear alcohol ethoxylates, and alkyl glucosides, and mono and di-alkyl substituted ethoxylated, phenols wherein the number of ethoxy (EO) groups in the first surfactant are about 8 to 20, and in the second surfactant are 3 to 7. A preferred surfactant is an alkyl phenoxy poly alcohol.

The emulsions of this invention are prepared by a two step process: (1) forming a thick mixture of wax, Fischer-Tropsch process water, and the first surfactant, i.e. a "pre-emulsion", and (2) mixing the product of step 1 with the second surfactant to form the stable emulsion.

Step 1 is effectively carried out by melting the wax, usually by heating in excess of about 80° C., mixing the wax with Fischer-Tropsch process water and the first surfactant, and providing sufficient shear to produce a pre-emulsion or a thick emulsion. Preferably, the Fischer-Tropsch process water and surfactant are also heated to about the same temperature as the wax. It is also preferred to mix the Fischer-Tropsch process water and surfactant prior to mixing either with the wax. The resulting mixture is usually cooled to ambient temperature, although not always necessarily, before carrying out Step 2. Upon mixing the pre-emulsion with the second surfactant, the mixture is again subjected to sufficient shear for a time period sufficient to form a stable, macro emulsion. The degree of shear for each step as well as shear time for each step may be readily determined with minimal experimentation.

While any suitable mixing or shearing device may be used, static mixers as described in U.S. Pat. Nos. 5,405,439, 5,236,624, and 4,832,747 and incorporated herein by reference are preferred for forming the wax emulsions of this invention.

To more completely describe this invention, a series of examples, including comparison tests, are described and present in outline form in Table 4 herein below.

The Fischer-Tropsch process is well known to those skilled in the art, see for example, U.S. Pat. Nos. 5,348,982 and 5,545,674 incorporated herein by reference and typically involves the reaction of hydrogen and carbon monoxide in a molar ratio of about 0.5/1 to 4/1, preferably 1.5/1 to 2.5/1, at temperatures of about 175–400° C., preferably about 180°–240°, at measures of 1–100 bar, preferably about 10–40 bar, in the presence of a Fischer-Tropsch catalyst, generally a supported or unsupported Group VIII, non-noble metal, e.g., Fe, Ni, Ru, Co and with or without a promoter, e.g. ruthenium, rhenium, hafnium, zirconium, titanium. Supports, when used, can be refractory metal oxides such as Group IVB, i.e., titania, zirconia, or silica, alumina, or silica-alumina. A preferred catalyst comprises a non-shifting catalyst, e.g., cobalt or ruthenium, preferably cobalt with ruthenium, rhenium or zirconium as a promoter, preferably rhenium supported on silica or titania, preferably titania. The Fischer-Tropsch liquids, i.e., $C_5$+, preferably $C_{10}$+, are recovered and light gases, e.g., unreacted hydrogen and CO, $C_1$ to $C_3$ or $C_4$ and water are separated from the hydrocarbons.

The non-shifting Fischer-Tropsch process, also known as hydrocarbon synthesis may be shown by the reaction.

$$(2n)\ H_2 + nCO \longrightarrow C_nH_{2n+2} + nH_2O$$

A preferred source of water for preparing the emulsions of this invention is the process water produced in the Fischer-Tropsch process, preferably a non-shifting process. A generic composition of this Fischer-Tropsch process water is shown below and in which oxygenates are preferably <2 wt %, more preferably less than 1 wt %:12

| | |
|---|---|
| $C_1$–$C_{12}$ alcohols | 0.05–2 wt %, preferably 0.05–1.5 wt % |
| $C_2$–$C_6$ acids | 0–50 wppm |
| $C_2$–$C_6$ ketones, aldehydes, acetates | 0–50 wppm |
| other oxygenates | 0–500 wppm |

EXAMPLE 1 (COMPARATIVE)

The conventional method for preparing emulsions entails melting the wax and blending the melted wax with hot Fischer-Tropsch process water in the presence of a surface active ingredient. This example shows that the conventional method is not effective for preparing a concentrated wax in water emulsion that is stable and can be transported by pipeline.

A $C_{10}$+ solid wax, i.e., $C_{10}$–$C_{100}$, from a Fischer-Tropsch process utilizing a cobalt/rhenium on titania catalyst and having an average molecular weight of 577 (determined by high resolution mass spectrometry), C-85%, H-14.94%, density of about 0.8/0.85 gm/cc, was heated to 85° C. and melted, in an oven. 35 ml of Fischer-Tropsch process water (specific composition shown in Table 1), a preferred water source for this invention, having the generic composition shown above was also heated to 85° in a Waring blender. 1.75 gm of an ethoxylated nonyl phenol surfactant with 9 moles of ethylene oxide (O) was added to the Fischer-Tropsch process water and the mixture was mixed at 1000 rpm for 30 seconds to fully mix the Fischer-Tropsch process water and surfactant. 80 ml of molten wax was added to the water-surfactant mixture in the blender and blended at 10,000 rpm for 20 seconds, created a wax-in-water emulsion containing 70% wax and 1.8% surfactant with the remainder being Fischer-Tropsch process water. Upon cooling to ambient temperature, the emulsion became too thick (paste like) to be transported by pipeline.

Two other tests were performed using the same surfactant but with 15 EO's and 20 EO's. In both cases, the wax-in-water emulsions when cooled to ambient (room) temperature became thick and paste like.

Additional tests with the same materials but with reduced amounts of wax showed that stable emulsions could not be made with wax contents of greater than 20 vol %.

EXAMPLE 2

(Emulsification by this Invention)

This Example shows how a stable concentrated emulsion can be prepared according to the present invention.

A 70% (by volume) wax-in-water emulsion was created at elevated temperature following the first part of the procedure of Example 1. The surfactant was an ethoxylated nonyl phenol with 9 moles of EO. The emulsion was cooled to room temperature. As in Example 1, the emulsion became paste like and did not pour (similar to a petroleum jelly). Then 3.0 g of a second surfactant with 5 moles of EO was added to the emulsion and the mixture blended for 5 minutes at 3000 rpm in the Waring blender at room temperature. The paste like emulsion became pourable. The total surfactant concentration in the emulsion was 4.8% by weight. No additional Fischer-Tropsch process water was added in the second step and, hence, the water content was still 30% by volume. The emulsion was stable for at least 5 months.

This Example shows that a 70% by volume wax-in-water emulsion can be prepared using the two-step emulsification process. The emulsion is a stable, favorable liquid at room temperature, e.g., pours by ordinary gravity.

EXAMPLE 3: (COMPARATIVE)

Addition of Both Surfactants at Elevated Temperature

Example 2 used two surfactants, one with 9 EO at 85° C. and the other with 5 EO at room temperature. This Example shows that the inclusion of both surfactants at 85° C. is not effective in preparing a stable emulsion useful for pipeline transport.

The proportion of wax and water in the emulsion, and the emulsification conditions in this Example were the same as those in Example 1, the only difference being that both surfactants (one with 9 EO and the other with 5 EO) were added at 85° C. A wax-in-water emulsion was created at 85° C. which upon cooling to room temperature became thick. The thick emulsion was not favorable, and therefore was not suitable for pipeline transport.

EXAMPLE 4 (COMPARATIVE)

Addition of Both Surfactants at Room Temperature

Solid wax and Fischer-Tropsch process water were blended at room temperature using the same proportion as that in Example 1. The surfactant with 9 EO was added first. This created a granular thick paste. Upon addition of the surfactant with 5 EO, the paste became thinner with smaller grains of solid wax.

EXAMPLE 5 (COMPARATIVE)

Emulsification with 9 EO Surfactant at Room Temperature

An attempt to make an emulsion using 1.8% 9 EO surfactant with the balance being a 70:30 ratio of wax and Fischer-Tropsch process water at room temperature was unsuccessful; a thick paste was formed.

EXAMPLE 6 (COMPARATIVE)

Emulsification with 5 EO Surfactant at 85° C.

An attempt to make an emulsion using 1.8% 5 EO surfactant with the balance being a 70:30 ratio of wax and Fischer-Tropsch process water was unsuccessful; a thick paste was formed at 85° C. On cooling the emulsion, thinned somewhat, but was still of much higher consistency than required for pipeline transport.

EXAMPLE 7

Blending by the Method of this Invention with Conventional Water

An attempt to make an emulsion using 70% wax, 30% water, and surfactants exactly as per Example 2 above, was made with conventional distilled water instead of Fischer-Tropsch process water. In this case, while not all of the water could be incorporated into the emulsion during the first step, the emulsion was stable, favorable and adequate for pipeline transport, although there was a separate water phase. Thus, Fischer-Tropsch process water shows an advantage in preparing the wax-water emulsion.

EXAMPLE 8

Transporting Waxes by Blending with Fischer-Tropsch Process Water 20 kg of Fischer-Tropsch wax is heated to melt all of the wax. The melted wax is mixed with 80 kg of Fischer-Tropsch process water to form a pre-emulsion. Fischer-Tropsch process water contains enough suitable organics to stabilize this pre-emulsion. The pre-emulsion is mixed with a second nonionic surfactant having an HLB of less than 11 to form a wax in water emulsion. Enough shearing action in mixing is used to ensure an adequate macro-emulsion. The macro-emulsion is transported in a pipeline at room temperature.

EXAMPLE 9

Transporting Waxes by Blending with Fischer-Tropsch Process Water 20 kg of Fischer-Tropsch wax is heated to melt all of the wax. The melted wax is mixed with 80 kg of Fischer-Tropsch process water and a first nonionic surfactant having an HLB of at least 11 to produce a pre-emulsion. The pre-emulsion is mixed with a second nonionic surfactant having an HLB of less than 11 to form a wax in water emulsion. Enough shearing action in mixing is used to ensure an adequate macro-emulsion. The macro-emulsion is transported in a pipeline at room temperature.

TABLE 1

COMPOSITION OF FISCHER-TROPSCH PROCESS WATER

| Compound | Wt % | ppm O |
|---|---|---|
| Methanol | 0.70 | 3473.2 |
| Ethanol | 0.35 | 1201.7 |
| 1-Propanol | 0.06 | 151.6 |
| 1-Butanol | 0.04 | 86.7 |
| 1-Pentanol | 0.03 | 57.7 |
| 1-Hexanol | 0.02 | 27.2 |
| 1-Heptanol | 0.005 | 7.4 |
| 1-Octanol | 0.001 | 1.6 |
| 1-Nonanol | 0.0 | 0.3 |
| Total Alcohols | 1.20 | 5007.3 |

TABLE 1-continued

COMPOSITION OF FISCHER-TROPSCH PROCESS WATER

| Acid | Wppm | wppm O |
|---|---|---|
| Acetic Acid | 0.0 | 0.0 |
| Propanoic Acid | 1.5 | 0.3 |
| Butanoic Acid | 0.9 | 0.2 |
| Total Acids | 2.5 | 0.5 |
| Acetone | 17.5 | 4.8 |
| Total Oxygen | | 5012.6 |

TABLE 2

SUMMARY OF METHODS AND RESULTS

| Example | Stage 1 | Stage 2 | Result |
|---|---|---|---|
| 1 | 85° C.: 9EO surfactant 70% wax | none | thick paste |
| | 85° C.: 15EO surfactant 70% wax | none | thick paste |
| | 85° C.: 20EO surfactant 70% wax | none | thick paste |
| | 85° C.: 9EO surfactant <20% wax | none | good emulsion |
| 2 | 85° C.: 9EO surfactant 70% wax | RT: 5 EO surfactant | good, stable emulsion |
| 3 | 85° C.: 9EO + 5 EO surfactants 70% wax | none | thick paste |
| 4 | RT: 9EO + 5 EO surfactants 70% wax | none | thin, granular paste |
| 5 | RT: 9EO surfactant 70% wax | none | thick paste |
| 6 | 85° C.: 5EO surfactant 70% wax | none | thick paste |
| 7 | 85° C.: 9EO surfactant 70% wax, distilled water | RT: 5 EO surfactant | partial good emulsion |

RT= room temperature.

What is claimed is:

1. A hydrocarbon in water emulsion, the emulsion having 20 weight % to about 90 weight % Fischer-Tropsch wax, comprising:

Fischer-Tropsch process water;

of a Fischer-Tropsch derived wax, said wax by itself is solid at room temperature, comprising at least about 20 weight %, based on the weight of the wax and Fischer-Tropsch process water;

from about 0.25 to 5 weight %, based on the weight of the wax and Fischer-Tropsch process water, of a first nonionic surfactant selected from mono- and dialkyl ethoxylated phenols having from 2 to 20 carbon atoms in the alkyl groups and having an HLB of at least 11; and from about 0.05 to 5 weight %, based on the weight of the wax and Fischer-Tropsch process water, of a second nonionic surfactant selected from mono- and dialkyl ethoxylated phenols having from 2 to 20 carbon atoms in the alkyl groups and having an HLB of less than 11.

2. An emulsion according to claim 1, wherein the second nonionic surfactant has an HLB of less than 10.

3. An emulsion according to claim 1, containing 0.05–1.0 weight % of non-Fischer-Tropsch alcohol.

4. An emulsion according to claim 1, wherein the first surfactant is entirely contained in the Fischer-Tropsch process water.

5. An emulsion according to claim 1, wherein the emulsion contains 20 weight % to about 70 weight % Fischer-Tropsch wax.

6. A method of forming a wax in water emulsion without the addition of a significant amount of a co-solvent, the emulsion having greater than 20 weight % and up to about 90 weight % Fischer-Tropsch wax, comprising:

melting a Fischer-Tropsch wax, said wax by itself is solid at room temperature, by heating to above 80° C.;

mixing at least 20 weight %, based on the weight of the wax and Fischer-Tropsch process water, of the melted wax with Fischer-Tropsch process water having an initial temperature of at least about 80° C., and a first nonionic surfactant having an HLB of at least 11 to produce a pre-emulsion; and mixing the pre-emulsion with a second non-ionic surfactant having an HLB of less than 11 to form a wax in water emulsion.

7. The method of claim 6, wherein the pre-emulsion reaches steady-state before mixing with the second nonionic surfactant.

8. A method of pumping wax through a conduit, comprising forming an emulsion according to claim 6 and pumping the emulsion through the conduit.

9. A method according to claim 8, wherein the conduit comprises at least in part a pipeline.

10. A method according to claim 6, wherein the first surfactant is entirely contained in the Fischer-Tropsch process water.

11. A method according to claim 6, wherein the emulsion contains 20 weight % to about 70 weight % Fischer-Tropsch wax.

* * * * *